US005189737A

United States Patent [19]

Ribicic

[11] Patent Number: 5,189,737

[45] Date of Patent: Mar. 2, 1993

[54] FIREMAN'S TURNOUT COAT

[75] Inventor: Theresa Ribicic, Mentor-on-the-Lake, Ohio

[73] Assignee: Ramwear, Inc., Mentor, Ohio

[21] Appl. No.: 742,511

[22] Filed: Aug. 5, 1991

Related U.S. Application Data

[63] Continuation of Ser. No. 392,262, Aug. 10, 1989, abandoned.

[51] Int. Cl.[5] ..... A41D 1/02; A41D 13/00

[52] U.S. Cl. ..... 2/93; 2/81; 2/96; 2/87; 2/97

[58] Field of Search ..... 2/69, 85-87, 2/93, 96, 97, 46, 118, 103, 69, 69.5, DIG. 6, 81, 96, 97, 93, 7.1 A

[56] References Cited

U.S. PATENT DOCUMENTS

| | | | |
|---|---|---|---|
| 2,672,615 | 3/1954 | Itri | 2/96 |
| 3,230,545 | 1/1966 | Galley | 2/96 X |
| 3,833,938 | 9/1974 | Schweid | 2/96 |
| 3,926,909 | 12/1975 | Wei | 260/45.85 |
| 4,118,804 | 10/1978 | Freese | 2/340 |
| 4,184,212 | 1/1980 | Bowman | 2/5 |
| 4,414,692 | 11/1983 | Dzinson et al. | 2/DIG. 6 |
| 4,507,806 | 4/1985 | Coombs | 2/97 |
| 4,549,315 | 10/1985 | English et al. | 2/2 |
| 4,561,121 | 12/1985 | Ehring et al. | 2/2 |
| 4,569,212 | 2/1986 | Larue | 266/196 |
| 4,604,759 | 8/1986 | Bowman et al. | 2/81 |
| 4,608,715 | 9/1986 | Miller et al. | 2/87 X |
| 4,631,753 | 12/1986 | Ehring | 2/85 |
| 4,633,527 | 1/1987 | Ehring | 2/2 |
| 4,715,068 | 12/1987 | Jacobsen | 2/DIG. 6 |
| 4,732,921 | 3/1988 | Hochberg et al. | 523/460 |
| 4,746,541 | 5/1988 | Marikar et al. | 427/126.1 |
| 4,768,233 | 9/1988 | Grilliot et al. | 2/97 |
| 4,774,725 | 11/1988 | Page | 2/81 |

FOREIGN PATENT DOCUMENTS

| | | | |
|---|---|---|---|
| 140991 | 4/1920 | United Kingdom | 2/96 |

*Primary Examiner*—Stuart S. Levy
*Assistant Examiner*—Joseph A. Rhoa
*Attorney, Agent, or Firm*—Fay, Sharpe, Beall, Fagan, Minnich & McKee

[57] ABSTRACT

A coat suitable for use by firefighters in firefighting featuring an outer shell portion (10), a liner (12), and a storm flap (90). The outer shell portion has right and left sleeves, and a body, the body having a right-front section a left-front section, and a back section. One of the front sections has a slit (40) extending generally from the top of one of the front sections to a point near the bottom of one front section. The storm flap has a first and second longitudinal edge and is attached to the liner via an attaching portion (96).

3 Claims, 3 Drawing Sheets

FIG. 3
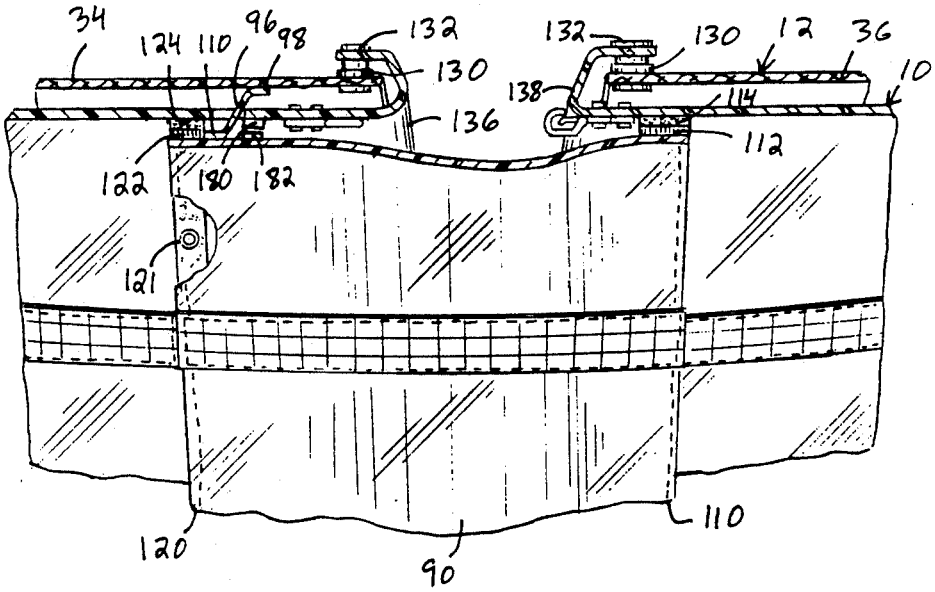
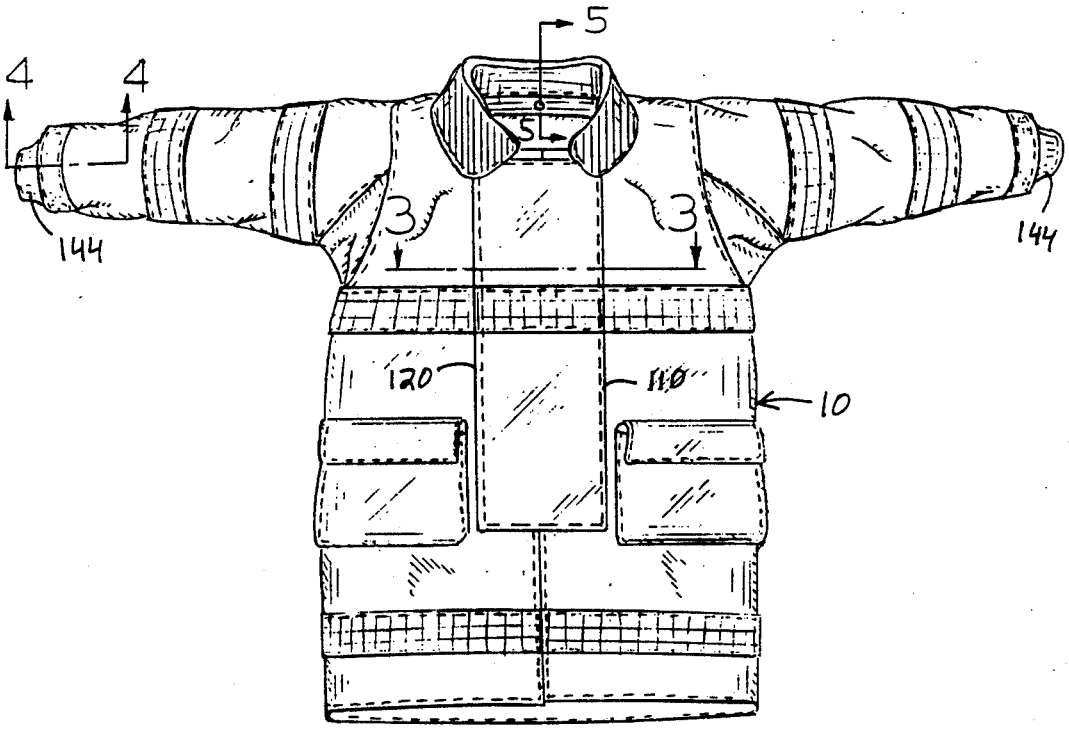
FIG. 2

FIREMAN'S TURNOUT COAT

This is a continuation of copending application Ser. No. 07/392,262 filed on Aug. 10, 1989, now abandoned.

BACKGROUND OF THE INVENTION

1. Field of the Invention

The present invention relates generally to protective outerwear for firefighting and more specifically to a fireman's turnout coat featuring a moisture-repellant outer shell and a thermal resistant liner.

2. Description of the Related Art

In many cases, protective outerwear for firefighters features an outer shell, designed primarily to repel water, and a liner, designed to protect the firefighter's body from the moisture and intense heat sometimes encountered while firefighting. The combination of the shell and liner is often heavy and uncomfortable in the elevated temperatures associated with firefighting. Some firefighters have demonstrated a tendency to remove the liner and wear the outer shell alone. This arrangement provides inadequate protection to the firefighter and can result in injury.

One advantage of the current invention is to provide a firefighter's turnout coat with a visual indication of the liner's presence to ensure supervisory personnel that the firefighter is wearing his protective coat correctly. Other coats designed for firefighting with related advantages are disclosed in U.S. Pat. No. 4,774,725 and U.S. Pat. No. 4,507,806.

It is another advantage of the current invention to provide a coat whose operability is significantly diminished when worn improperly. This encourages the wearer utilizing the equipment properly to protect himself. A reference related to this advantage is U.S. Pat. No. 4,768,233.

Another objective of the current invention is to keep the firefighter as dry and comfortable as possible while fighting the fire. Some references disclosing a firefighter's coats with similar advantages are U.S. Pat. No. 4,604,759 and U.S. Pat. No. 4,631,753. In addition, another advantage of the invention is the comfort it provides to firefighters who carry materials strapped to their backs, such as oxygen packs. The invention is constructed so a to minimize the discomfort often associated with the straps.

SUMMARY OF THE INVENTION

In a coat according to the broader aspects of the present invention, the coat comprises an outer shell, the outer shell having right and left sleeves and a body. The body has a right-front section, a left-front section, and a back section. One of the front sections has a slit extending generally from the top of one front section to a point near the bottom of one front section. The coat also has a liner and a storm flap. The storm flap has a first and second longitudinal edge. The storm flap is fixedly attached to the liner via an attaching means.

More particularly, in accordance with the invention, the coat has a closure means, one portion of the closure means fixedly attached to the right-front section and the closure means fixedly attached to the left-front section of the coat. The closure means is adapted for selectively closing the coat by joining the right-front section to the left-front section. The storm flap is adapted to selectively cover the closure means.

Another advantage of the invention is a first fire-retardant hook-and-loop strip on the inner surface of the storm flap in a corresponding second fire-retardant hook-and-loop strip on the outer surface of the body positioned to selectively engage the first fire-retardant hook-and-loop strip. The first fire-retardant hook-and-loop strip on the inner surface of the storm flap extends longitudinally along and closely adjacent the first longitudinal edge of the storm flap. The second fire-retardant hook-and-loop strip on the outer surface of the body extends longitudinally at the dorsal edge of the closure means on the left-front section.

Another advantage of the invention is that the storm flap selectively covers the junction of the right-front and left-front sections and extends at least three inches on each side of the junction of the right-front and left-front sections when the coat is properly secured as designed.

Another advantage of the invention is a first fire-retardant hook-and-loop strip extending longitudinally along the interior of the storm flap closely adjacent to the second longitudinal edge. A corresponding second fire-retardant hook-and-loop strip extends longitudinally along the dorsal side of the slit and is positioned to selectively engage the first fire-retardant hook-and-loop strip.

Another advantage of the invention is a plurality of spaced-apart male snaps in the second fire-retardant hook-and-loop strip extending longitudinally along the dorsal side of the slit. A plurality of spaced-apart female snaps in the first fire-retardant hook-and-loop strip extend longitudinally along the inner side of the storm flap closely adjacent to the second longitudinal edge. The female snaps are positioned to selectively receive a corresponding male snap.

Another advantage of the invention is a third fire-retardant hook-and-loop strip on the inner surface of the right-front section extending longitudinally along the ventral side of the slit. A fourth fire-retardant hook-and-loop strip extends on the outer surface of the outer shell near the ventral side of the slit and corresponds with the third fire-retardant hook-and-loop strip.

Another advantage of the invention is a plurality of spaced-apart male snaps in the third fire-retardant hook-and-loop strip and a plurality of spaced-apart female snaps in the fourth fire-retardant hook-and-loop strip. The female snaps are positioned to selectively receive a corresponding male snap.

Another advantage of the invention is a liner comprising an outer layer manufactured of a water-resistant material and an inner layer manufactured of thermal-resistant material. The inner layer is sewn to the outer layer throughout the inner face of the inner and outer layers. Shoulder pads are interposed between the outer and inner layers.

Another advantage of the invention is shoulder pads which are interposed between and permanently sewn to the inner and outer layers of the liner.

BRIEF DESCRIPTION OF THE DRAWINGS

Other aspects of the invention will become apparent from the following description when read in conjunction with the accompanying drawings wherein:

FIG. 2 is a plan view of the outer shell and the liner when properly assembled;

FIG. 3 is an exploded cross-sectional perspective view taken along line 3—3 of FIG. 2;

DETAILED DESCRIPTION OF THE PREFERRED EMBODIMENT

The invention also may be understood in the context of the following definitions which are applicable to both the specification and the appended claims.

"Dorsal" means toward the back of the garment when the garment is being properly worn by the firefighter.

"Ventral" means toward the front of the garment when the garment is being correctly worn by the firefighter.

"Inner" means the direction toward the firefighter's body when the coat is being properly worn.

"Outer" means the direction away from the firefighter's body when the coat is being properly worn.

"Upper" means the direction toward the firefighter's head when the coat is being properly worn.

"Lower" means the direction toward the firefighter's feet when the coat is being properly worn.

"Outer shell" is a moisture-repellant outer garment designed to protect the liner, and thereby the firefighter, from water and other damaging elements. In the United States, this garment complies with N.F.P.A. 1971.

"Liner" is a garment designed to be worn underneath an outer shell and which protects the firefighter from the moisture and elevated temperatures associated with firefighting. The liner has two primary layers, each directed toward a different function. The outer layer is primarily designed to repel moisture. The inner layer is primarily designed to protect the firefighter from heat.

"Velcro ®" is a registered trademark of Velcro Inc. Velcro ® is one type of closure means utilizing hooks and loops. Although Velcro ® is the preferred type of fire-retardant hook-and-loop closure, any other suitable fire-retardant hook-and-loop closure can be used. The term "fire-retardant Velcro ® strip" means a patch of fire-retardant Velcro ® material, either a hook portion or a loop portion. The strips are "corresponding" if one is a hook and one is a loop, so that they will work together.

Figure 1:
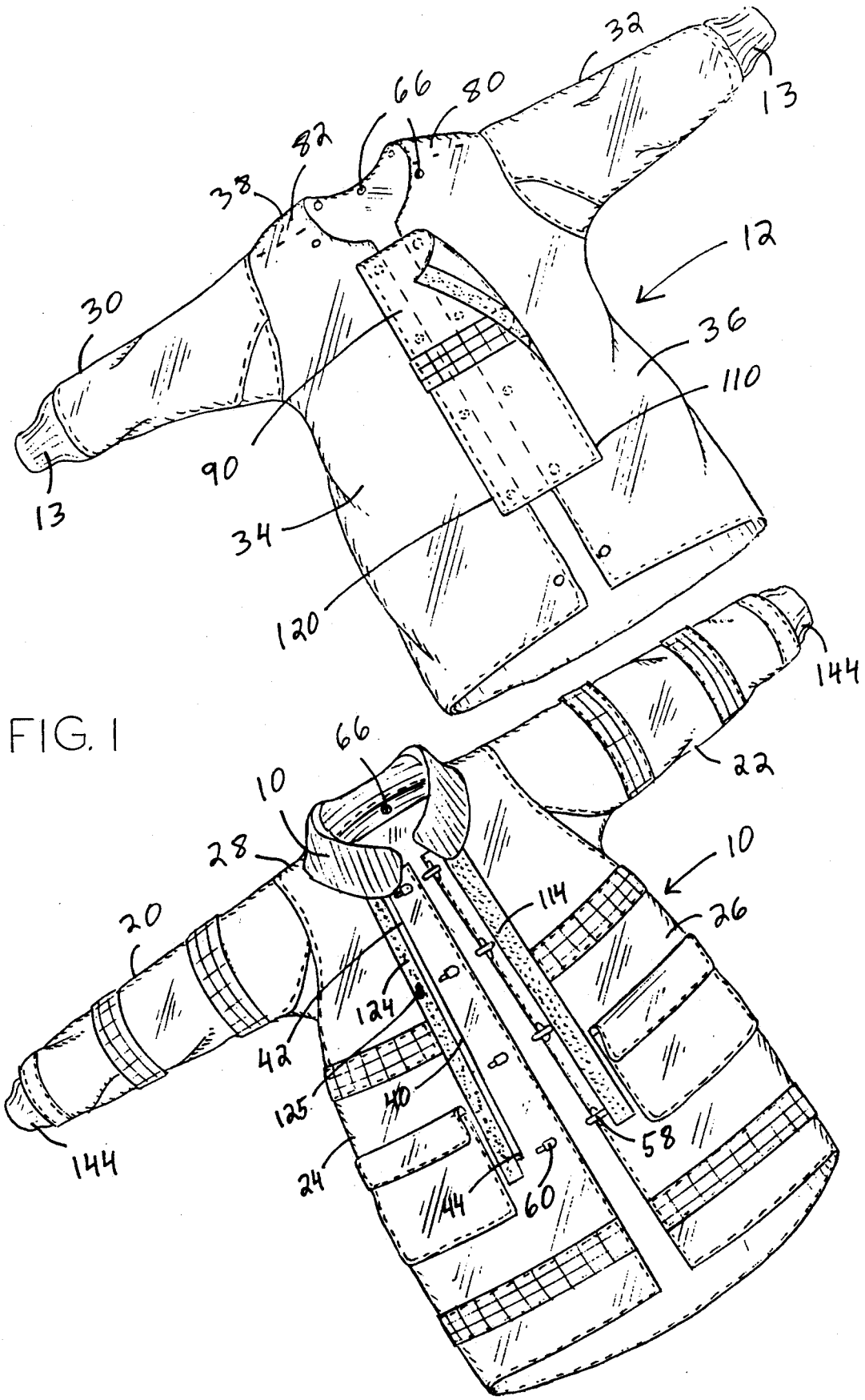
FIG. 1 is an exploded plan view of the outer shell and the liner.

In the drawings, the same numerals are used for the same components or items in the several views. With particular reference now to FIG. 1, there is illustrated an outer shell 10 and a liner 12. The outer shell has a right sleeve 20, a left sleeve 22, a right-front section 24, a left-front section 26, and a back section 28. The main function of the outer shell is to protect the liner from the water, cinders, and snags that are associated with firefighting. The outer shell can be made of any material suitable for the purpose. Materials are usually chosen by regulating agencies or by the customer. One suitable material is an aromatic polyamide, such as NOMEX III ®. NOMEX III ® is a registered trademark of the E. I. DuPont De Nemours & Co.

The liner 12 has a right sleeve 30, a left sleeve 32, a right-front section 34, a left-front section 36, and a back section 38. The liner has two primary layers. The outer layer is a moisture barrier designed to protect the inner layer and the firefighter from moisture. The outer layer can be made of any material suitable for the intended purpose and the material is usually chosen by regulating agencies or by the customer. One suitable material is an aromatic polyamide, such as NOMEX III ®. NOMEX III ® is a registered trademark of the E. I. DuPont De Nemours & Co.

The inner layer is a thermal barrier designed to protect the firefighter's body from the elevated temperatures associated with fire-fighting. The inner layer of the liner 12 can be made of any material suitable for the intended purpose and the material is usually chosen by regulating agencies or by the customer. One suitable material is an aromatic polyamide, such as NOMEX III ®. NOMEX III ® is a registered trademark of the E. I. DuPont De Nemours & Co.

Preferably the liner is fully sealed by means of a certified sealing tape. In the preferred embodiment, at the sleeve bottoms, a knit wristlet 13 is sewn between the thermal barrier and the moisture barrier. The wristlet is approximately seven inches in length.

A slit 40 is located in the right-front section 24 of the outer shell 10. The upper end 42 of the slit 40 is located approximately four inches below the top edge of the outer shell. Depending on the length of the coat, the lower end 44 of the slit is located different distances from the bottom of the outer shell. In a coat measuring forty inches from the front of the collar to the bottom of the outer shell, the lower end of the slit is located thirteen inches from the bottom of the outer shell. In a coat measuring thirty-five inches from the front of the collar to the bottom of the outer shell, the lower end 44 of the slit is located approximately five inches from the bottom of the outer shell.

Along the junction of the right-front section 24 and left-front section 26 of the outer shell 10 are a plurality of spaced-apart hook 58 and dee 60 closures. The hook and dee closure are made of a non-ferrous material. The hooks are held in position by means of capped rivets. Other closures means, such as zippers, can be used with the invention.

In a plurality of locations on the outer shell 10 and the liner 12 snaps 66, 121, 125, 130, 132 are attached. These snaps consist of a male portion and female portion positioned to cooperate with each other. The snaps preferably are made of nickel-plated brass.

Figure 6:
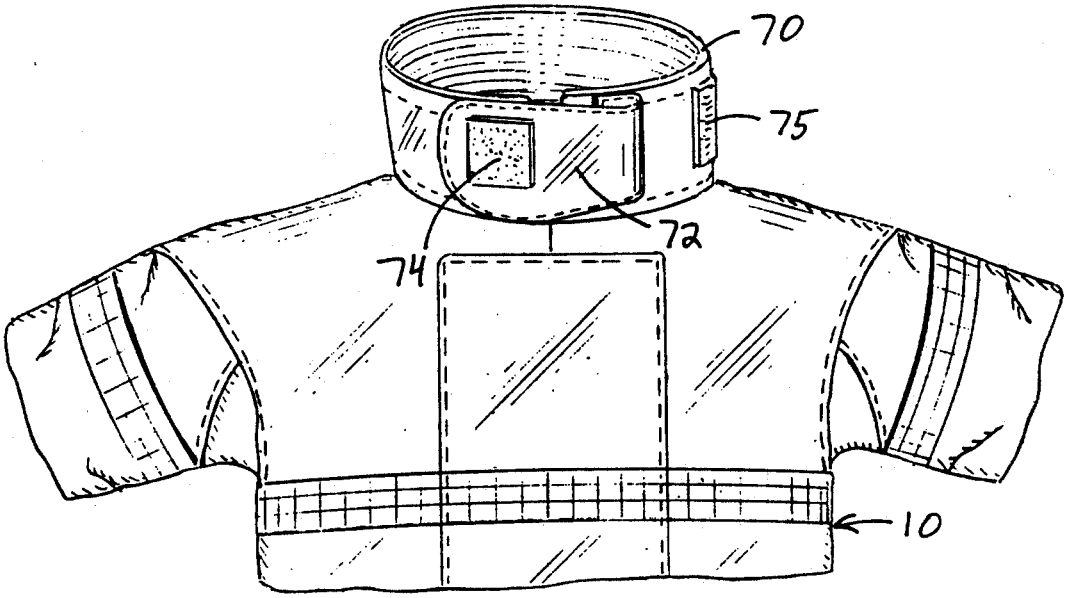
FIG. 6 is a front view of the throat tab of the outer shell.

With reference to FIGS. 1 and 6, at the top of the outer shell 10 is a collar 70. Preferably the collar consists of four layers. The outer-most layer, when the collar is in the raised position as shown in FIG. 6, is manufactured of the same material as the outer shell. The next two layers are manufactured of moisture barrier fabric, such as the outer layer of the liner. The innermost layer is manufactured of corduroy. The collar includes a throat tab 72 which may be selectively fastened to protect the firefighter's throat from injury. The throat tab may be fastened by use of fire-retardant Velcro ® strip 74. When the collar is not raised, as shown in FIG. 1, Velcro ® tab 75 secures the throat tab. The throat tab preferably has a bulbous shape, with the top edge of the throat tab being generally linear and the lower edge of the throat tab being more rounded. This shape better protects the firefighter's throat.

With reference to FIG. 1, in the shoulder area of the liner 12 are shoulder pads 80, 82. The shoulder pads are interposed between the outer layer and inner layer of the liner. In the preferred embodiment, the shoulder pads are constructed from neoprene-coated aramid fibers in the form of needlepunch. The shoulder pads are helpful in reducing the stress and discomfort of the firefighter when carrying items such as an oxygen pack. An oxygen pack is usually borne on the firefighter's back by means of straps. The shoulder pads are positioned to protect the shoulders of the firefighter from these straps. Because the shoulder pads are positioned between the layers of the liner, and sewn to each layer of the liner, the shoulder pads remain correctly positioned to provide optimum comfort for the wearer. Furthermore, sewing the shoulder pads to the liner, rather than attaching through fire-retardant Velcro® strips or some other attaching means, provides greater comfort to the wearer. Fire-retardant Velcro® strips occasionally can shift or provide a point of discomfort.

A storm flap 90 is adapted to selectively fit through the slit 40. With reference to FIG. 2, the liner, outer shell, and storm flap are shown when being properly worn by the firefighter. With reference to FIG. 3, the storm flap 90 is attached to the right-front section 34 of the liner 12 via an attaching means 96. In the preferred embodiment, the attaching means is a narrow strip of the same material as the outer shell. In the preferred embodiment, a first longitudinal edge 98 of the attaching means is sewn to the edge of the right-front section of the liner and a second longitudinal edge 100 is sewn to the inner surface of the storm flap 90. The length of the storm flap will vary with the length of the coat. In a preferred embodiment, the storm flap is approximately six inches wide and twenty-seven inches long.

On the inner surface of the storm flap 90, along the first longitudinal edge 110 of the storm flap, is fixed a fire-retardant Velcro® strip 112. This fire-retardant Velcro® strip selectively cooperates with a second fire-retardant Velcro® strip 114 which extends longitudinally along the dorsal edge of the hook closures 58 on the left-front section 26 of the outer shell 10, as seen best in FIG. 1. This pair of fire-retardant Velcro® strips helps keep the storm flap closed when the coat is in use. Note that the storm flap covers the junction of the hook and dee closures as well as the junction of the left-front 26 and right-front sections 24 of the outer shell 10.

The inner surface of the second longitudinal edge 120 of the storm flap 90 has a fire-retardant Velcro® strip 122. A corresponding fire-retardant Velcro® strip 124 is attached along the dorsal side of the edge of the right-front section 24 of the outer shell 10. The fire-retardant Velcro® strips 122, 124 selectively cooperate to secure the storm flap to the outer shell. A plurality of spaced-apart male snaps 121 are attached in the fire-retardant Velcro® strip 122. A corresponding plurality of spaced-apart female snaps (not shown) are attached in the fire-retardant Velcro® strip 124. The female snaps are positioned to selectively receive the corresponding male halves and further secure the storm flap to the outer shell.

On the outer surface of the outer shell 10, on the ventral side of the slit 40, is located a Velcro® strip 180. On the inner surface of the storm flap 90, near the ventral edge of the second longitudinal edge 100 of the attaching means 96 is a corresponding Velcro® strip 182. A plurality of spaced-apart snaps (not shown) are located in the Velcro® strips 180, 182. The corresponding Velcro® strips 180, 182 and snaps are positioned to selectively engage each other and further secure the storm flap 90 to the outer shell 10.

With reference to FIGS. 1–3, the liner 12 is adapted to selectively fit within the outer shell 10 and to be attached thereto. A plurality of male snaps 130 extend longitudinally along the inner surface of the edge of the right-front section 34 and left-front section 36 of the liner. A plurality of spaced-apart corresponding female snaps 132 extend longitudinally along the outer surface of extensions 136 and 138. The snaps 130, 132 are positioned to selectively receive the corresponding other half and to secure the liner 12 to the outer shell 10.

Figure 4:
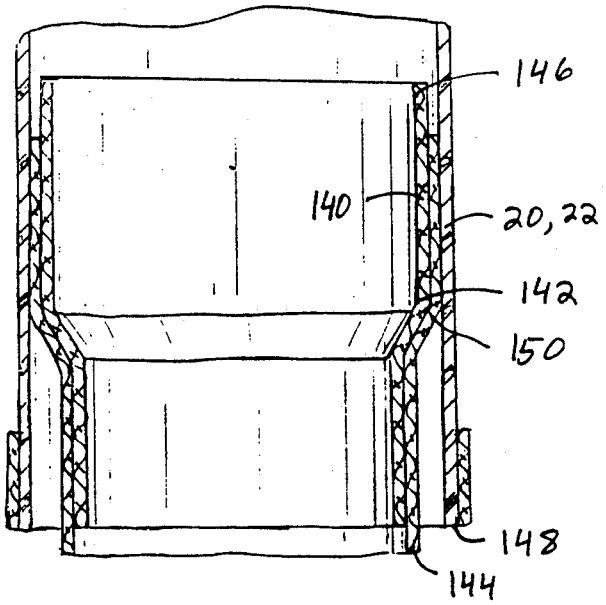
FIG. 4 is a cross-sectional view of a sleeve well.

With reference to FIG. 4, each sleeve 20, 22 of the outer shell 10 has a sleeve well 140. The sleeve well consists of a barrier fabric 142 and a wristlet 144. The barrier fabric is made of a moisture-repellant material. A first edge 146 of the barrier fabric is attached to the interior of the sleeve 20, 22 at a point approximately 3 inches from the end 148 of the sleeve. The second edge 150 of the barrier fabric is attached to a wristlet. The wristlet is made of an elastic material so as to fit snugly around the firefighter's wrist. The sleeve well acts to prevent water from entering the sleeve and soaking the liner. In the preferred embodiment, only the sleeves 20, 22 of the outer shell feature a sleeve well. In another embodiment, the sleeves 20, 22, 30, 32 of both the liner 12 and the outer shell 10 feature sleeve wells.

Figure 5:
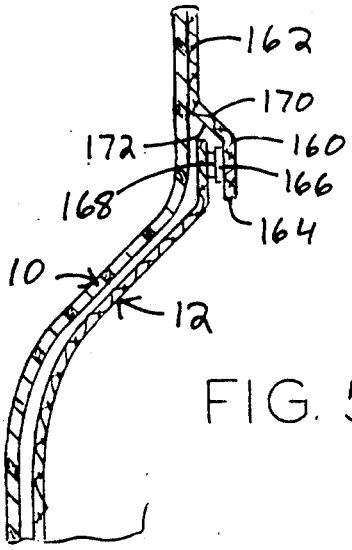
FIG. 5 is a cross-sectional view taken along 5—5 of FIG. 2.

With reference to FIG. 5, there is disclosed a moisture barrier extension 160. The moisture barrier extension 160 has a first edge 162 which is sewn near the top edge of the outer shell 10. The moisture barrier extension extends downwardly to a second edge 164. Near this second edge is attached a plurality of spaced-apart female snaps 166. These snaps are adapted to receive corresponding male snaps 168 which are spaced-apart near the top edge of the liner 12. The inner surface 170 of the moisture barrier extension is made of a thermal resistant material. This material covers the snaps 166 so that they do not contact the firefighter's skin. The material on the outer surface 172 of the moisture barrier extension 160 is made of a water-resistant material. The moisture barrier extension acts to prevent water from entering the turnout coat and soaking the liner.

The invention has been described with reference to a preferred embodiment. Obviously, modifications and alterations will occur to other upon a reading and understanding of this specification. It is intended to include all such modifications and alterations insofar as they come within the scope of the appended claims or the equivalents thereof.

What is claimed is:

1. A coat suitable for use by firefighters in firefighting, the coat, when worn as designed, comprising:

an outer shell, the outer shell having right and left sleeves and a body, the body having a right-front section, a left-front section, and a back section;

a slit in one of the front sections, the slit extending generally from a first endpoint near but below a top of the one front section to a second endpoint near but above a bottom of the one front section;

an opening in the outer shell extending from a top edge of the front sections to a bottom edge of the front sections, the opening selectively separating the right-front section from the left-front section;

a liner; and, a storm flap, the storm flap having a first and second longitudinal edge, the storm flap being fixedly attached to the liner via an attaching means, the storm flap selectively extending outwardly through the slit and covering the opening thereby indicating the liner is being properly worn under the outer shell.

2. The coat as in claim 1 further comprising a closure means, one portion of the closure means fixedly attached to the right-front section and the other portion of the closure means fixedly attached to the left-front section, the closure means adapted for selectively closing the coat by joining the right-front section to the left-front section thereby closing the opening in the outer shell, the storm flap selectively covering the closure means.

3. A firefighter's turnout coat, when properly worn by a firefighter the coat comprising:

an outer shell having first and second front sections, each front section having top, bottom, and side edges, the side edges being generally vertical and parallel and defining therebetween an access opening, the access opening selectively openable by spreading the side edges apart;

closure means affixed to each front section near its respective side edge, the closure means on the first front section selectively linking with the closure means on the second front section to hold the side edges together;

a slit in the first front section of the outer shell, the slit extending generally parallel to the side edge of the first front section and spaced therefrom, the closure means on the first front section being located between the slit and the side edge of the first front section, the length of the slit being less than the length of the side edge of the first front section;

a liner, and, a storm flap attached to the liner and selectively extending outwardly through the slit and across the access opening to cover the closure means, thereby indicating that the liner is being properly worn within the outer shell.

* * * * *